United States Patent [19]

Syrchikov et al.

[11] 4,163,680

[45] Aug. 7, 1979

[54] PROCESS FOR CARBONITRIDING STEEL AND CAST IRON ARTICLES

[76] Inventors: Sergei A. Syrchikov, ulitsa Sverdlova, 180, kv. 33; Vladimir L. Tulsky, Moskovsky prospekt, 96, kv. 143, both of Tolyatti Kuibyshevskoi oblasti, U.S.S.R.

[21] Appl. No.: 742,630

[22] Filed: Nov. 17, 1976

[30] Foreign Application Priority Data

Nov. 21, 1975 [SU] U.S.S.R. ..... 2191966[I]

[51] Int. Cl.[2] ..... C21D 1/48

[52] U.S. Cl. ..... 148/16.5; 148/16.6

[58] Field of Search ..... 148/16.5, 16.6, 12.1; 423/365, 420; 260/555 A, 543

[56] References Cited

U.S. PATENT DOCUMENTS

| | | | |
|---|---|---|---|
| 3,232,797 | 1/1966 | Bessen | 148/16.6 |
| 3,310,367 | 3/1967 | Mavrovic | 423/420 |
| 3,492,100 | 1/1970 | Roubin et al. | 423/365 |
| 3,748,195 | 7/1973 | Kondo et al. | 148/16.6 |
| 3,929,878 | 12/1975 | Mavrovic | 260/555 A |
| 3,940,440 | 2/1976 | Mavrovic | 260/555 A |
| 4,003,764 | 1/1977 | Wunning | 148/16.6 |

FOREIGN PATENT DOCUMENTS

| | | | |
|---|---|---|---|
| 2063287 | 7/1971 | France | 148/16.6 |
| 1156180 | 6/1969 | United Kingdom | 148/16.5 |

OTHER PUBLICATIONS

"CRC Handbook of Chemistry and Physics", 58th Ed., CRC Press, Inc., Cleveland, Ohio, 1977, p. C536.

Heat Treatment of Metals, 1975-2, pp. 39–49.

The Condensed Chemical Dictionary, Van Nostrand Reinhold Co., N.Y., Hawley, 1974, p. 51.

*Primary Examiner*—L. Dewayne Rutledge

*Assistant Examiner*—John P. Sheehan

*Attorney, Agent, or Firm*—Lackenbach, Lilling & Siegel

[57] ABSTRACT

The proposed process for carbonitriding steel and cast iron articles comprises the saturation of these articles with carbon and nitrogen at a temperature of 550° to 650° C. in a carbonitriding medium of vaporous ammonium carbamate.

The invention finds extensive application to aircraft manufacturing, automotive industry, machine-tool manufacture and precision mechanics for surface hardening of steel and cast iron articles.

5 Claims, No Drawings

PROCESS FOR CARBONITRIDING STEEL AND CAST IRON ARTICLES

The present invention relates to machine building and, more particularly, to thermochemical treatment of articles in aircraft engineering, automotive engineering, electrical industry, machine-tool building, precision mechanics, as well as in manufacturing tools of carbon and alloy steels and cast irons.

Mechanical engineering makes use of various surface hardening techniques, including carbonitriding which ensures high hardness, wear and fatigue resistance, and high pyrogenic stability due to the saturation of the surface of articles with carbon and nitrogen.

There is known a method for carbonitriding steel and cast iron articles (the Tenifer process), whereby on the surface of an article there is produced a compound comprising the E-phase and a diffusion layer (cf. B. Finnern, "Härterei-Technik und Wärmebehandlung," No. 3, 1964; Osnovi Tenifer-pestupka, "Zästita materijala," 1970, t. 18, No. 3, S. 108).

The Tenifer process consists in placing articles, preheated to a temperature of 400° to 450° C., in a melt composed of potassium and sodium cyanides and cyanates and soaking the articles in said melt for a certain period of time at 500° to 600° C.

As a result of the Tenifer process, on the surface of an article there is produced a porous zone (the E-phase) which is 5 to 16 mm thick, and a diffusion zone which is 0.15 to 0.5 mm thick. The Tenifer process has the following disadvantages:

The use of cyanides and cyanates calls for personnel protection measures;

The process calls for special equipment and techniques to neutralize the treated articles and chemical wastes;

The process is technologically unstable: the composition of the melt changes continuously, and is accompanied by the accumulation of ferrocyanides (complex iron salts); this raises the porosity of the carbonitride layer and impairs its properties; as a result, periodic cleaning of the equipment, as well as periodic surveillance of the cyanide, cyanata and soda content are necessary, whereby the utilization factor is reduced;

The existing analytical control techniques do not provide for effective control of the saturation capacity.

There is known another carbonitriding process with a homogeneous E-layer. It is known as the Nitrok method (cf. J. Wünning, Neues Verfahren und Anlagen zum Nitrieren mit E-Verbendungsschicht, AWT, 1974).

According to the latter method, a gaseous mixture is fed into a furnace, consisting of ammonia and exogas (10 percent by volume of carbon dioxide and 90 percent by volume of nitrogen) taken in the ratio of 1:2 and having a temperature of 570° C. As a result, a carbonitriding medium is produced inside the furnace, consisting of 14 to 15 percent by volume ammonia, 3.5 to 3.7 percent by volume of carbon monoxide, 17 to 19 percent by volume of hydrogen, 2.2 percent by volume of carbon dioxide, and 3.5 percent by volume of steam, the remainder being nitrogen. In this case it takes more time to produce carbonitride layers, as compared to the Tenifer process. The Nitrok method is carried out in specially designed furnaces, wherein provision is made for adding exogas to the gases released from the furnace to rule out explosion hazards.

The Nitrok method has the following disadvantages:

the process involves the risk of an explosion, because the working medium contains a total of 35 to 38 percent by volume of combustible gases, which calls for the use of special equipment;

the process involves consumption of considerable quantities of ammonia and exogas;

the formation of the carbonitride layer is too slow.

It is an object of the present invention to eliminate the above disadvantages.

It is the main object of the invention to simplify the carbonitriding process.

It is another object of the invention to improve the hardness of the carbonitride layer and raise the rate at which metal is saturated with carbon and nitrogen.

It is still another object of the invention to make the process explosion-proof and rule out the effects of toxic substances.

The foregoing objects are attained by providing a process of carbonitriding steel and cast iron articles by saturating them with carbon and nitrogen at a temperature of 550° to 650° C. in a carbonitriding medium. According to the invention, the carbonitriding medium is vaporous ammonium carbamate.

In order to make the process more economical (to reduce losses of ammonium carbamate), it is recommended that the carbonitriding medium should be a mixture of vaporous ammonium carbamate and an inert gas. The content of ammonium carbamate vapors in the mixture must be no less than 8 percent by volume.

This object can also be attained by using a carbonitriding medium which is a mixture of vaporous ammonium carbamate with an inert gas, hydrogen, carbon monoxide and steam. The content of ammonium carbamate vapors in the mixture must be no less than 8 percent by volume.

According to the invention, a carbonitriding medium consisting of vaporous ammonium carbamate is produced by reacting ammonia with carbon dioxide at a temperature of 20° to 150° C.; the stoichiometric ratio between ammonia and carbon dioxide is 2:1.

A carbonitriding medium, which is a mixture of vaporous ammonium carbamate and an inert gas, with a concentration of vaporous ammonium carbamate in the mixture of no less than 8 percent by volume, is produced by mixing ammonia with a gas mixture containing no less than 8 percent by volume of carbon dioxide and an inert gas. The mixing is done at a temperature of 20° to 150° C., with two volume units of ammonia being taken per volume unit of carbon dioxide.

A carbonitriding medium, which is a mixture of vaporous ammonium carbamate with an inert gas, hydrogen, carbon monoxide and steam, is produced by mixing ammonia with a gas mixture containing no less than 8 percent by volume of carbon dioxide, an inert gas, hydrogen, carbon monoxide and steam at a temperature of 20° to 150° C.; two volume units of ammonia are taken per volume unit of carbon dioxide.

The proposed carbonitriding process is carried out as follows.

Articles are placed in a furnace at a temperature of 550° to 650° C. and soaked in vaporous ammonium carbamate, $NH_4O(CO)NH_2$, or in a mixture of ammonium carbamate, $NH_4O(CO)NH_2$, with an inert gas, or in a mixture of ammonium carbamate with an inert gas, hydrogen, carbon monoxide and steam. The concentration of vaporous ammonium carbamate, $NH_4O(CO)NH_2$, in the mixture must be no less than 8 percent by volume. The soaking time and temperature and the composition of the carbonitriding medium depend on the grade of metal and the required saturation depth.

Ammonium carbamate, $NH_4O(CO)NH_2$, is supplied into the furnace in the crystalline or vaporous state. As it has been stated above, in order to make the process more economical, ammonium carbamate $NH_4O(CO)NH_2$ is mixed with an inert gas, or with an inert gas, hydrogen, nitrogen oxide and steam; the concentration of vaporous ammonium carbamate in the mixture must be no less than 8 percent by volume.

The mixture of vaporous ammonium carbamate with an inert gas is produced by mixing ammonia with carbon dioxide and an inert gas at a temperature of 20° to 150° C.; the ratio between the ammonia content and that of carbon dioxide is 2:1.

The mixture of vaporous ammonium carbamate with an inert gas, hydrogen, carbon monoxide and steam is produced, for example, by mixing ammonia with exogas containing 8 to 11 percent by volume of carbon dioxide, 2 to 3 percent by volume of hydrogen, 2 to 3 percent by volume of carbon monoxide, and 2 to 3.5 percent by volume of steam, the rest being nitrogen. The mixing is done at a temperature of 20° to 150° C.; the ratio between the ammonia content and that of carbon dioxide must be 2:1.

Carbonitriding media may also be mixtures of ammonium carbamate and exogases of various compositions (for example, the exogas may have the following composition: carbon dioxide, 10 percent by volume; steam, 3.5 percent by volume; the rest being nitrogen).

In all the aforesaid cases, the production of the carbonitriding medium is based on the reaction $$2NH_3+CO_2=NH_4O(CO)NH_2.$$

At a temperature of 550° to 650° C., ammonium carbamate reacts with metal (steel or cast iron articles) as follows:

$$NH_4O(CO)NH_2+9Fe=2Fe_3N+Fe_3C+2H_2O+H_2.$$

The reaction products, which are a mixture of iron nitrides and carbides, $Fe_3(CN)$, form the carbonitride layer (the $\epsilon$-phase); steam, hydrogen, excess ammonium carbamate and inert gases are removed from the furnace. The latter products are explosion-proof and do not contain any highly toxic compounds.

The proposed method has the following advantages over the conventional processes:

- the rate of saturating metal with carbon and nitrogen is increased 100 to 150 percent, as compared to the treatment in molten cyanides;
- the proposed process makes it possible to obviate the use of cyanides;
- the absence of porosity accounts for an improved quality of the carbonitride layer (the $\epsilon$-phase);
- the process is non-toxic and explosion-proof;
- wear, fatigue and shock resistance of steel and cast iron articles is raised 50 to 100 percent, as compared to the effects of the Tenifer method.

Other objects and advantages of the present invention will be better understood from the following examples of preferred embodiments thereof.

EXAMPLE 1

Articles of steel having the following composition:
carbon 0.33 wt.%
manganese, 1.7 wt.%
silicon, 0.3 wt.%
sulpur, 0.03 wt.%
phosphorus, 0.03 wt.%
lead, 0.3 wt.%, the rest being iron, are placed in a furnace at a temperature of 580° C. and soaked for two hours in a carbonitriding medium consisting of vaporous ammonium carbamate mixed with nitrogen and steam. The carbonitriding medium is produced beforehand by mixing ammonia with exogas of the following composition:

carbon dioxide, 10 percent by volume
steam, 3.5 percent by volume the rest being nitrogen.

The ammonia to exogas ratio is 1:5.05. This means that the ammonia to carbon dioxide ratio is 2:1. After the process the articles are cooled. The carbonitride layer thus produced is 10 to 15 mμ thick; the depth of the diffusion layer is 0.3 mm. The hardness of the carbonitride layer is 1,200 to 1,300; VH, 0.015.

EXAMPLE 2

Articles of steel having the following composition:
carbon, 0.17 wt.%
manganese, 0.5 wt.%
chromium, 0.7 wt.%
sulphur, 0.016 wt.%
phosphorus, 0.03 wt.%
nickel, 1.8 wt.%
molybdenum, 0.3 wt.%
silicon, 0.15 wt.%, the rest being iron, — are placed in a furnace at a temperature of 590° C. and soaked for two hours in vaporous ammonium carbamate which is obtained beforehand by mixing ammonia with carbon dioxide. The ammonia to carbon dioxide ratio is 2:1.

The cooled articles have a carbonitride layer of 15 to 20μ; the depth of the diffusion layer is 0.3 to 0.4 mm.

The hardness of the carbonitride layer is 1,000 to 1,100 VH 0.015.

EXAMPLE 3

Articles of steel having the following composition:
carbon, 0.11 wt.%
manganese, 0.6 wt.%
silicon, 0.3 wt%
chromium, 0.62 wt.%
nickel, 0.73 wt%
phosphorus, 025 wt%
sulphur, 0.07 wt.%, the rest being iron, are placed in a furnace at a temperature of 560° C. and soaked during two hours in a mixture of ammonium carbamate with nitrogen, hydrogen, carbon oxide and steam.

The carbonitriding medium is produced in advance by mixing ammonia with exogas containing the following ingredients:
carbon dioxide, 8 percent by volume
hydrogen, 3 percent by volume
carbon monoxide, 2.5 percent by volume
steam, 2.6 percent by volume,
nitrogen, the rest.

The ammonia to exogas ratio is 1:6.25. The ammonia to carbon dioxide ratio is 2:1.

The cooled articles have a carbonitride layer of 8 to 10μ; the diffusion layer is 0.2 mm thick.

The hardness of the carbonitride layer is 950 to 1,100, VH, 0.015.

EXAMPLE 4

Articles of steel having the following composition:
carbon, 0.42 wt.%
chromium, 0.7 wt.%
manganese, 0.7 wt.%
nickel, 0.85 wt.%
molybdenum, 0.25 wt.%
sulphur, 0.02 wt.%
phosphorus, 0.021 wt.%, the rest being iron,
are placed in a furnace at a temperature of 640° C. and soaked during one hour and a half in a mixture of ammonium carbamate and argon. The carbonitriding medium is produced by mixing ammonia with a mixture of 25 percent by volume of carbon dioxide and 75 percent by volume of argon. The ammonia to carbon dioxide ratio is 2:1.

The cooled articles have a carbonitride layer of 25 to 40μ; the depth of the diffusion layer is 0.3 to 0.4 mm. The hardness of the carbonitride layer is 900 to 950; VH, 0.015.

EXAMPLE 5

Articles of cast iron of the following composition:
carbon, 3.6 wt.%
silicon, 2.46 wt.%
manganese, 0.36 wt.%
chromium, 0.068 wt.%
nickel, 0.87 wt.%
lead, 0.016 wt.%
sulphur, 0.012 wt.%
copper, 0.35 wt.%, the rest being iron,
are placed in a furnace at a temperature of 575° C. and soaked during two hours in a mixture of ammonium carbamate and nitrogen, hydrogen, carbon monoxide and steam. The medium is produced beforehand by mixing ammonia with carbon dioxide and exogas having the following composition: carbon dioxide, 10 percent by volume; hydrogen, 1 percent by volume; carbon monoxide, 2 percent by volume; steam, 3 percent by volume; the rest being nitrogen. In said mixture, the ammonia ratio is 1:5.5. The ammonia to carbon dioxide ratio is 2:1.

The cooled articles have a carbonitride layer of 10 to 20μ.

The hardness of the carbonitride layer is 1,200 to 1,300; VH, 0.015.

What is claimed is:

1. A process for carbonitriding articles of steel and cast iron by saturating said articles with a carbonitriding medium of vaporous ammonium carbamate at a temperature of 550° to 650° C., said vaporous ammonium carbamate being produced by evaporating crystalline ammonium carbamate or by reacting ammonia with carbon dioxide at a temperature of 20° to 150° C., the stoichiometric ratio between ammonia and carbon dioxide being 2:1, and wherein the ammonium carbamate carbonitriding reaction occurs as follows:

$$NH_4O(CO)NH_2+9Fe=2Fe_3N+Fe_3C+2\text{-}H_2O+H_2.$$

2. A process as claimed in claim 1, wherein the carbonitriding medium is a mixture of vaporous ammonium carbamate and an inert gas, the concentration of ammonium carbamate vapors in the mixture being no less than 8 percent by volume.

3. A process as claimed in claim 1, wherein the carbonitriding medium is a mixture of vaporous ammonium carbamate and an inert gas, hydrogen, carbon monoxide and steam, the concentration of ammonium carbamate vapors in the mixture being no less than 8 percent by volume.

4. A process as claimed in claim 2, wherein the mixture of ammonium carbamate and an inert gas is produced by mixing ammonia with a gas mixture containing no less than 8 percent by volume of carbon dioxide and an inert gas at a temperature of 20° to 150° C., ammonia being taken in an amount of two volume units per volume unit of carbon dioxide.

5. A process as claimed in claim 3, wherein the mixture of ammonium carbamate and an inert gas, hydrogen, carbon monoxide and steam is produced by mixing ammonia with a gas mixture containing no less than 8 percent by volume of carbon dioxide, an inert gas, hydrogen, carbon monoxide and steam, the mixing being carried out at a temperature of 20° to 150° C., whereas ammonia is taken in an amount of 2 volume units per volume unit of carbon dioxide.

* * * * *